US007401620B2

(12) United States Patent
Ball

(10) Patent No.: US 7,401,620 B2
(45) Date of Patent: Jul. 22, 2008

(54) YARD HYDRANT WITH DRAIN PORT CHECK VALVE

(75) Inventor: William T Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 80 days.

(21) Appl. No.: 11/307,970

(22) Filed: Mar. 1, 2006

(65) Prior Publication Data

US 2006/0254647 A1 Nov. 16, 2006

Related U.S. Application Data

(60) Provisional application No. 60/669,611, filed on Apr. 8, 2005.

(51) Int. Cl.
*E03B 9/02* (2006.01)

(52) U.S. Cl. ..... 137/301; 137/272; 137/854; 137/107

(58) Field of Classification Search ..... 137/301, 137/107, 272, 854, 852, 843, 533.11, 533.29
See application file for complete search history.

(56) References Cited

U.S. PATENT DOCUMENTS

| | | | | | |
|---|---|---|---|---|---|
| 1,349,062 | A | * | 8/1920 | Goldberg | 137/283 |
| 2,913,000 | A | * | 11/1959 | Roberts | 137/854 |
| 3,858,599 | A | * | 1/1975 | Carlson | 137/307 |
| 3,980,097 | A | * | 9/1976 | Ellis | 137/283 |
| 4,483,361 | A | * | 11/1984 | Jungbert, Sr. | 137/301 |
| 4,842,018 | A | * | 6/1989 | White et al. | 137/614.11 |
| 5,289,840 | A | | 3/1994 | Anderson | |
| 6,684,900 | B1 | | 2/2004 | McKeague | |

* cited by examiner

*Primary Examiner*—Kevin L Lee
(74) *Attorney, Agent, or Firm*—Sheridan Ross P.C.

(57) ABSTRACT

A yard hydrant having a valve body with a drain port and a check valve mounted adjacent to the drain port to allow water to flow from the hydrant through the drain port to the ground and prevent ground water from flowing into the hydrant through the drain port and contaminating the water source.

4 Claims, 4 Drawing Sheets

YARD HYDRANT WITH DRAIN PORT CHECK VALVE

CROSS REFERENCE TO A RELATED APPLICATION

This application is based upon Applicants' Provisional Application Ser. No. 60/669,611 filed Apr. 8, 2005.

BACKGROUND OF THE INVENTION

This invention is directed toward a yard hydrant, and more specifically to a yard hydrant that prevents contaminants and the like from entering the yard hydrant.

Yard hydrants are well known in the art and have an inlet valve connected to a water supply that is located below the frost line in the ground. When a hydrant is shut off, a drain port at the inlet valve is opened to allow water in the hydrant to drain out. The problem with this design is that ground water or other contaminants can enter the yard hydrant through the same drain port, thus creating an unacceptable cross-connection.

Therefore, there is a need in the art for an improved yard hydrant.

Thus, a principal objective of the present invention is to provide a yard hydrant that prevents backflow through the drain port.

A further objective is to provide a yard hydrant that is more easy and simple to repair.

These and other objectives will be apparent to those skilled in the art.

SUMMARY OF THE INVENTION

A yard hydrant having a valve body coupled to an inlet water pipe, a standpipe coupled to a valve body, and a head casting coupled to the standpipe. The valve body has a valve seat and a drain port. Disposed within the valve body is a valve or plunger attached to an actuator rod or valve stem that extends vertically through the standpipe and is operatively connected to a lever or faucet handle. The head casting has an inlet port, an outlet port and a conduit that extends from the inlet port to the outlet port. Mounted within or exterior to the valve body is a check valve that is positioned to prevent the flow of ground water or other contaminants from entering the yard hydrant through the drain port.

DETAILED DESCRIPTION OF THE PREFERRED EMBODIMENTS

Figure 1:
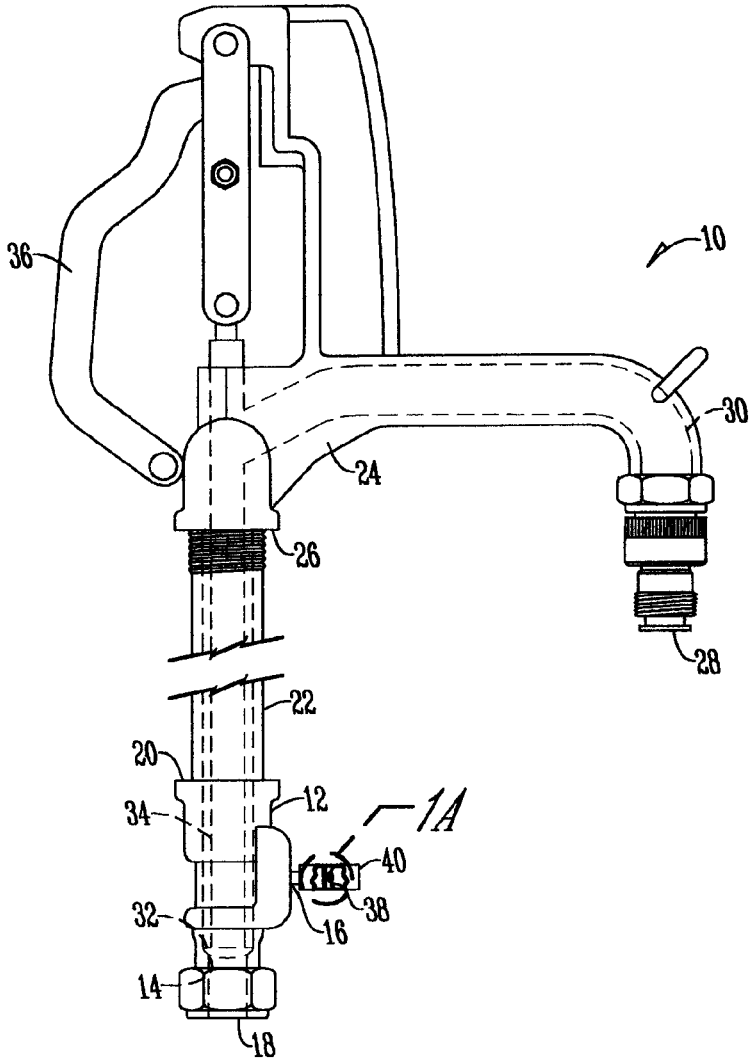
FIG. 1 is a side view of a yard hydrant.

A yard hydrant 10 has a valve body 12, a valve seat 14, a drain port or hole 16, an inlet 18 which is connected to a source of pressurized water (not shown) and an outlet 20 at its top. Connected at one end to the valve body 12 is a standpipe 22 that extends vertically and is connected to a head casting 24 at the opposite end.

The head casting 24 has an inlet 26 coupled to the standpipe 22 and a discharge conduit or outlet 28 that preferably extends downwardly and outwardly from the head casting 24 and a fluid conduit 30 that extends between the inlet 26 and the outlet 28.

Disposed within the valve body 12 is a closure valve or plunger 32 that is connected to a valve stem or actuator rod 34 that extends from the closure valve 32 through the standpipe 22 and is connected to an actuator device 36 attached to the head casting 24 such as a lever or handle.

Figure 1A:
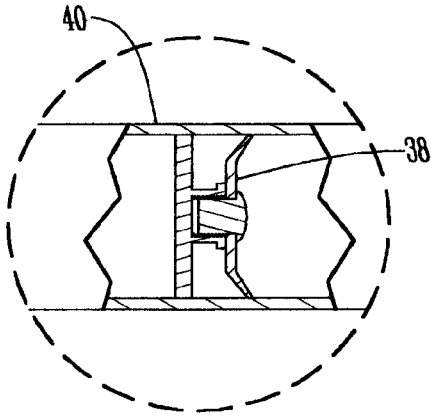
FIG. 1A is an enlarged side view of a check valve adjacent the drain port of a yard hydrant from FIG. 1.
Figure 2:
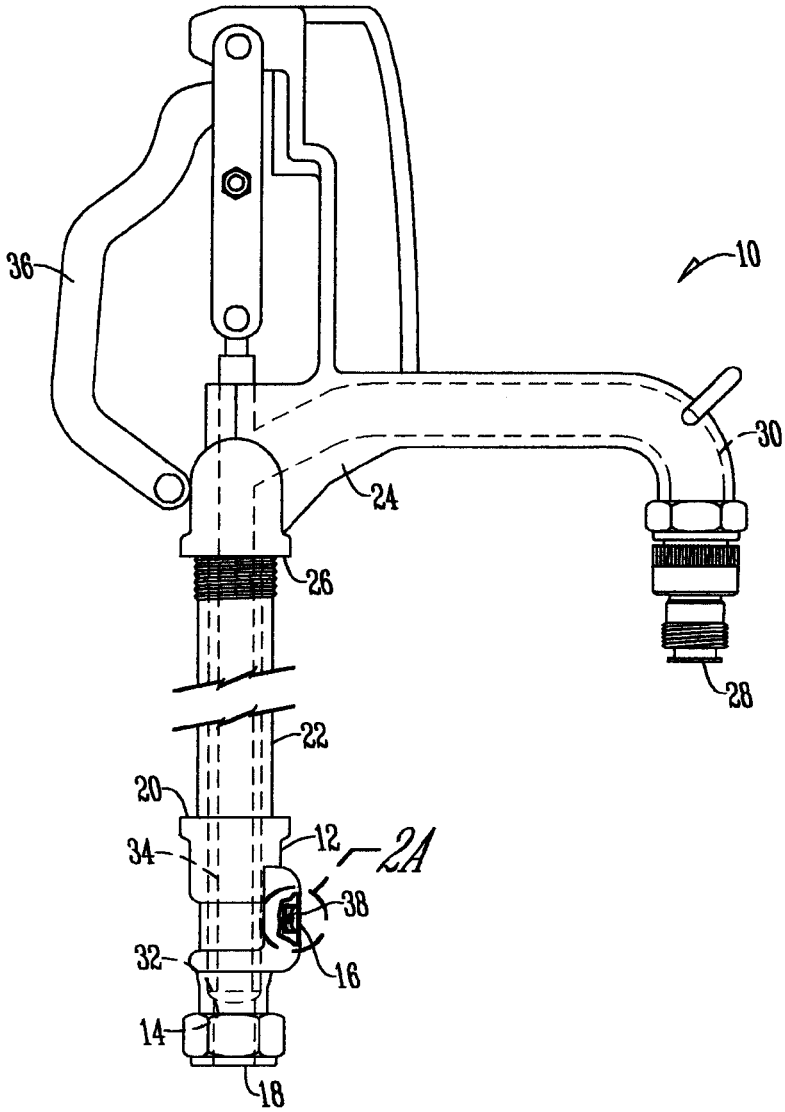
FIG. 2 is a side view of a yard hydrant.
Figure 2A:
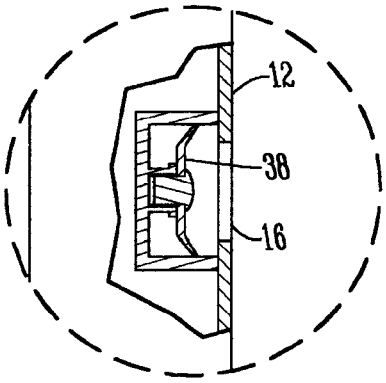
FIG. 2A is an enlarged side view of a check valve adjacent the drain port of a yard hydrant from FIG. 2.
Figure 3:
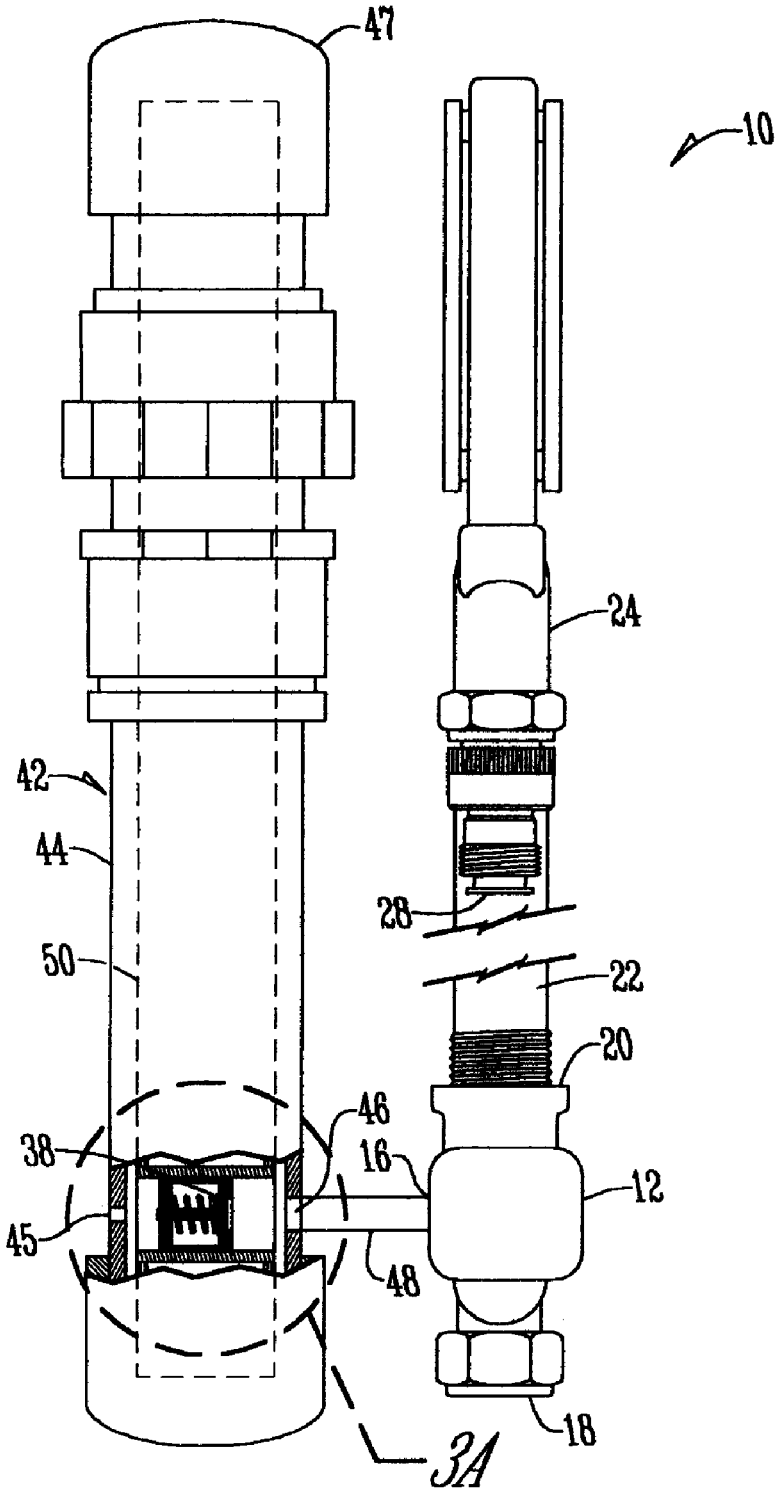
FIG. 3 is a front view of a yard hydrant with a separate hollow tube.
Figure 3A:
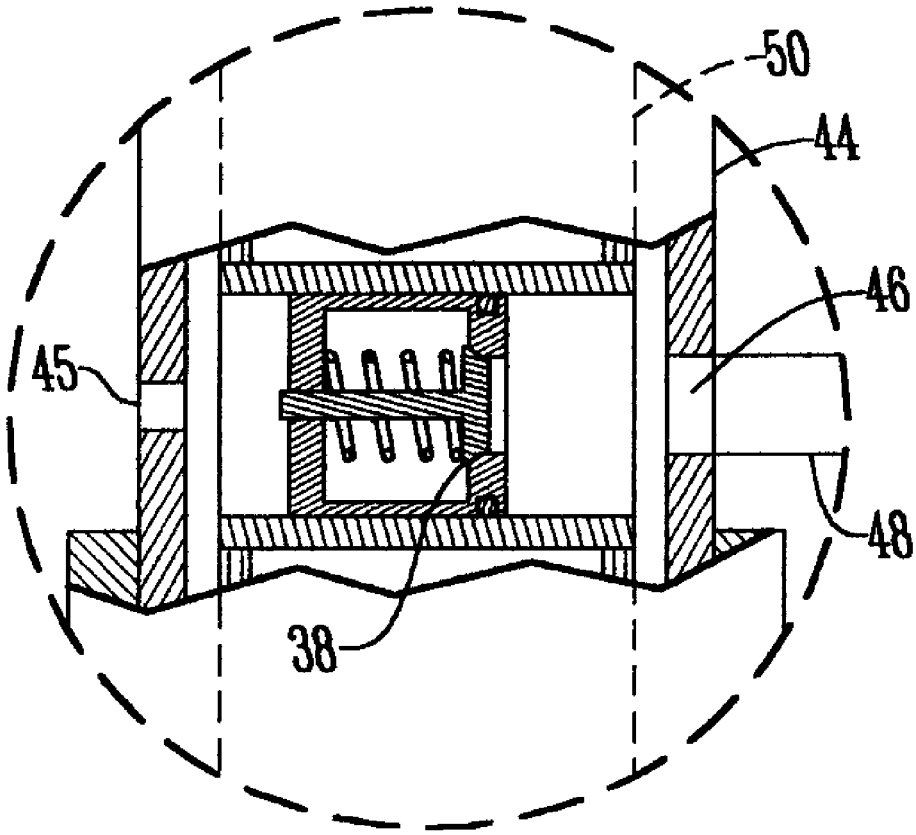
FIG. 3A is an enlarged side view of a check valve in communication with a drain port of a yard hydrant from FIG. 3.

Mounted adjacent to the drain port 16 is a check valve 38 that is positioned to allow fluid to flow from the valve body through the drain port 16 to the ground while preventing fluid from flowing from the ground back into the yard hydrant 10 through the drain hole 16. Alternatively the check valve is on the plunger 32. The check valve 38 is of any type such as a spring-loaded valve as shown in FIG. 3 or similar to that disclosed in U.S. Pat. No. 5,632,303 incorporated by reference herein in its entirety. The check valve 38 is mounted in any conventional manner such as, by example only, within a housing 40 in communication with the drain port 16 as shown in FIGS. 1 and 1A or mounted within the valve body 12 as shown in FIGS. 2 and 2A.

When the closure valve 32 engages the valve seat 14 the hydrant is in a closed position which prevents water from flowing from the water source to the discharge conduit 28. When the closure valve 32 is in the closed position the drain port 16 permits water to drain out of the pipe 22 and into the ground. The check valve 38 prevents water from flowing in the opposite direction from the ground into the hydrant 10 through the drain port 16. When the closure valve 32 is disengaged from the valve seat 14, the closure valve 32 seals the drain port 16 and water is permitted to enter the standpipe 22 and under pressure flow toward the discharge conduit 28.

In an alternative embodiment a separate pipe assembly 42 is attached to the yard hydrant 10. The pipe assembly has an elongated hollow tube 44 that extends vertically in spaced relation to the hydrant. The tube 44 preferably has two ports 45 and 46 positioned below the frost line. A cap 47 may be positioned at the opposite end. The port 46 is in fluid communication with drain port 16 by means of an integral molding/casting or the like or a connecting member or pipe 48. Alternatively drain port 16 is eliminated and there is a direct connection between the valve body 12 and port 46. Mounted within tube 44 and adjacent port 46 is a check valve 38 that is positioned to allow water to flow from the hydrant 10, through the drain port 16, to the connecting pipe 48 into tube 44 and subsequently into the ground through port 45 while also preventing water from entering the hydrant from the tube 44 or the ground. The check valve 38 can be mounted in any conventional manner. When the check valve 38 becomes worn or damaged it can be removed from the tube 44 by use of a tool and replaced. Alternatively, the check valve 38 is mounted within a second tube 50 having a diameter smaller than tube 44. Tube 50 fits within tube 44 such that check valve is aligned with port 46 to function in the same manner as previously described. Thus, the check valve 38 can be removed and replaced by removing the second tube from tube 44 or alternatively by a tool such as a rod.

A yard hydrant that reduces the possibility of contamination of the water supply from ground water through the drain port has been described. An alternative has also been described that allows for easy repair and replacement of such a yard hydrant. Thus, all the stated objectives have been met.

What is claimed is:

1. A yard hydrant comprising:

a valve body having an inlet, an outlet, and a drain port;

a standpipe coupled to the outlet of the valve body;

a head casting coupled to the standpipe;

a hollow tube connected to the valve body and in fluid communication with the drain port;

a second tube disposed within the hollow tube;

a check valve mounted within the second tube and positioned such that fluid will flow from the hydrant through the drain pipe and into the ground and fluid will not flow in the opposite direction the second tube being aligned within the hollow tube such that the check valve is aligned with the drain port—has been inserted following "direction".

2. A yard hydrant, comprising:

a valve body having a drain port; a stand pipe extending from the valve body and connected to a head casting;

a separate pipe assembly attached to the valve body and having an elongated hollow tube that is generally in spaced parallel relation to the stand pipe;

the separate pipe assembly being in fluid communication with the drain pipe and having a check valve mounted within the hollow tube.

3. The hydrant of claim 2 wherein a second tube is mounted within the hollow tube.

4. The hydrant of claim 3 wherein the check valve is mounted within the second tube.

* * * * *